US005346085A

United States Patent [19]

Svensson et al.

[11] Patent Number: 5,346,085

[45] Date of Patent: Sep. 13, 1994

[54] LOCKABLE CONTAINER

[75] Inventors: Maria Svensson, Hovas; Jan Nordlander, Lerum; Annika Andersson, Göteborg, all of Sweden

[73] Assignee: Molnlycke AB, Molnlycke, Sweden

[21] Appl. No.: 135,541

[22] Filed: Oct. 14, 1993

[30] Foreign Application Priority Data

Apr. 15, 1991 [SE] Sweden ..... 9101120

[51] Int. Cl.[5] ..... B65D 55/14

[52] U.S. Cl. ..... 220/210; 70/423

[58] Field of Search ..... 220/210; 70/63, 423, 70/455

[56] References Cited

U.S. PATENT DOCUMENTS 3,820,364 6/1974 Greeley ..... 70/419

4,277,962 7/1981 Lipschutz ..... 70/243

*Primary Examiner*—Allan N. Shoap

*Assistant Examiner*—Nova Stucker

*Attorney, Agent, or Firm*—Burns, Doane, Swecker & Mathis

[57] ABSTRACT

A lockable container is disclosed which has a base part and a cover which is pivotally attached to the base part. A lock has a lock catch which is adjustable between a locking position and a free position via key activation of the lock from the outside of the container. In its interior, the container is provided with a holder for a key belonging to the lock. The holder is arranged to form a storage place for the key and to securely hold the key when the lock is not being used. The holder is so located with respect to the lock that the lock catch, through mechanical contact with the key, is kept out of the locking position even when the cover is closed.

6 Claims, 3 Drawing Sheets

LOCKABLE CONTAINER

CROSS REFERENCE TO RELATED APPLICATIONS

This application is a continuation-in-part application of PCT SE/92/00236, filed on Apr. 10, 1992, and which designates the United States.

TECHNICAL FIELD

The present invention relates to a lockable container comprising a base part and a cover pivotally attached to the base part.

Background of the Invention

For many reasons it is desirable that a container is lockable, so that its contents is not accessible from the outside. It is naturally left to the choice of the user whether to utilize the locking possibility or not. This concerns for example so called dispensers for consumable materials in kitchens, toilets or similar, where in more public places it has shown itself to be necessary to be able to lock the container and to allow successive feeding out of for example contained paper, washing substances or the like. For smaller workplaces, for private use or similar it is however an inconvenience to keep track of the respective key and to unlock the container for refilling of the consumable material. A natural placement of the key is inside the container but placing the key somewhere in the container without any further arrangement will mean that the key will become locked inside, in the case that the lock is of the self-locking type with spring-return to the locking position upon closing of the container, which leads to obvious difficulties.

SUMMARY OF THE INVENTION:

It is therefore an object of the present invention to allow storage of the key inside a lockable container when the key is not in use, without giving rise to any inconvenience concerning locking-in of the key.

Said object is achieved in accordance with the present invention by means of a lockable container having an interior and an exterior, said container comprising

- a base part;
- a cover pivotally attached to the base part for displacement between a closed position in which the cover and the base delimit a substantially enclosed space and an open position;
- a lock mounted on said container, said lock presenting a lock catch operable from the exterior of the container by a key, which catch is displaceable between a locking position in which said catch engages a receiving portion and a free position;

wherein on the interior of the container, the container presents a holder for said key when said lock is not being activated, said holder being located with respect to the receiving portion such that the lock catch, through mechanical contact with the key, is prevented from engaging the receiving portion when the cover is in said closed position.

BRIEF DESCRIPTION OF THE DRAWINGS

The invention will now be explained in more detail with reference to an embodiment and to the accompanying drawings, in which.

DETAILED DESCRIPTION OF PREFERRED EMBODIMENTS

Figure 1:
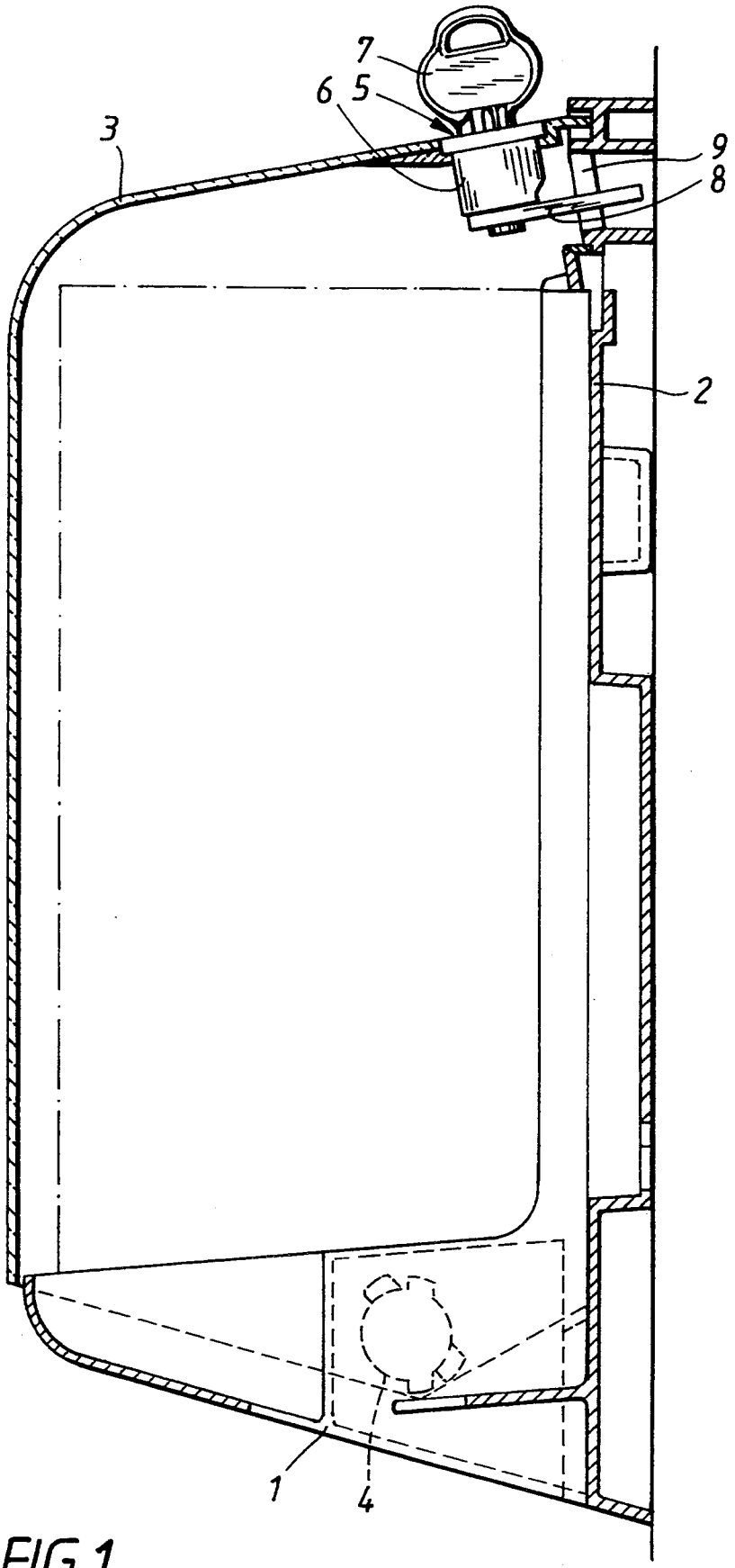
FIG. 1 shows a central longitudinal section through a lockable container according to the invention.
Figure 2:
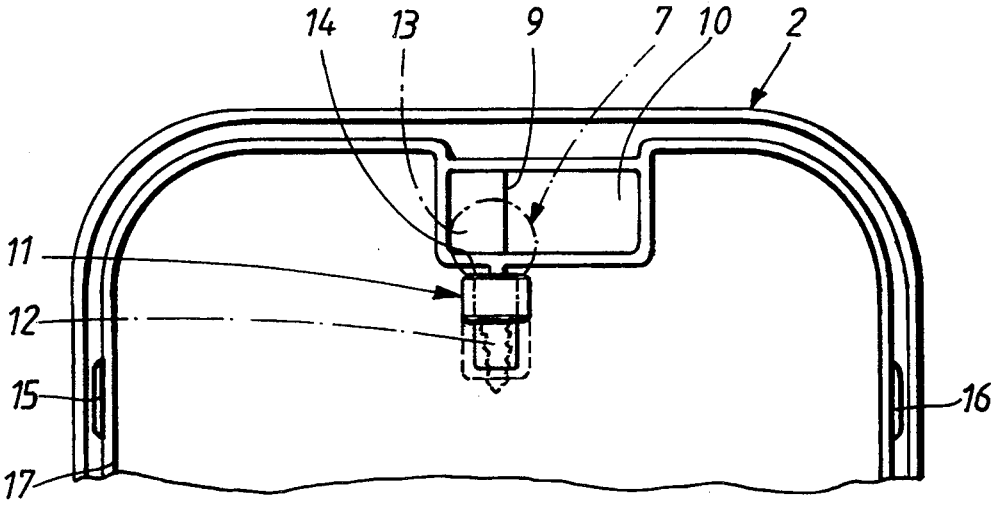
FIG. 2 shows a partial view of a base part belonging to the container.

As an example the container shown in FIGS. 1 and 2 is for example intended for containing drying paper, for example in the form of a pile of paper hand towels which are taken out from below via an exit opening 1. The container consists of a base part 2 in the form of a wall console, and a cover 3 lockable to this, which cover is pivotally connected with the wall console by means of two joints 4 positioned at either side of the exit opening 1. The cover 3 is thus joined to the console at the cover's lower end and lockable to the console at its upper end. The lockability is achieved by means of a lock 5, the main part of which is arranged in the cover and presents a locking cylinder 6 with a slot, in which is arranged a key 7 for locking and unlocking. The lock 5 has a lock catch 8 rotatable by means of the key, said lock catch being adjustable between a locking position and a free position, which will be more closely described below. As part of the lock there is arranged a locking edge 9 in the console 2 which, in the shown example, is formed by an opening edge portion of an opening 10 arranged in the console.

According to the invention, the container presents a holder 11 for the key arranged internally, which holder is so positioned that, with the key placed in the holder, the lock is prevented from assuming the locking position. In the shown example the holder is made as a simple holding loop, which is so dimensioned that the key's bit 12, i.e. its smaller portion, can be inserted into the closed loop whilst the head 13 of the key is supported against the loop's upper edge portion 14. The holder loop is so arranged laterally and vertically relative to the lock edge 9, so that when the key is in position its head partially covers the lock edge and projects slightly past this. Apart from with the help of the lock 5, the cover is maintained in a closed position against the console in another way so that the cover does not fall down uncontrollably as soon as the lock is in the free position. In the shown example the container is foreseen with two snap-locks 15, 16, which can be of a type known per se. For example the snap-locks can be formed as a projection in an upstanding edge part 17 on the console, which the cover overlaps in a closed position, whereby the cover presents a corresponding recess in which the projection can snap into since the cover's walls are elastically deformable and allow the wall of the cover to pass over the projection so that these can snap into the recesses.

Figure 3:
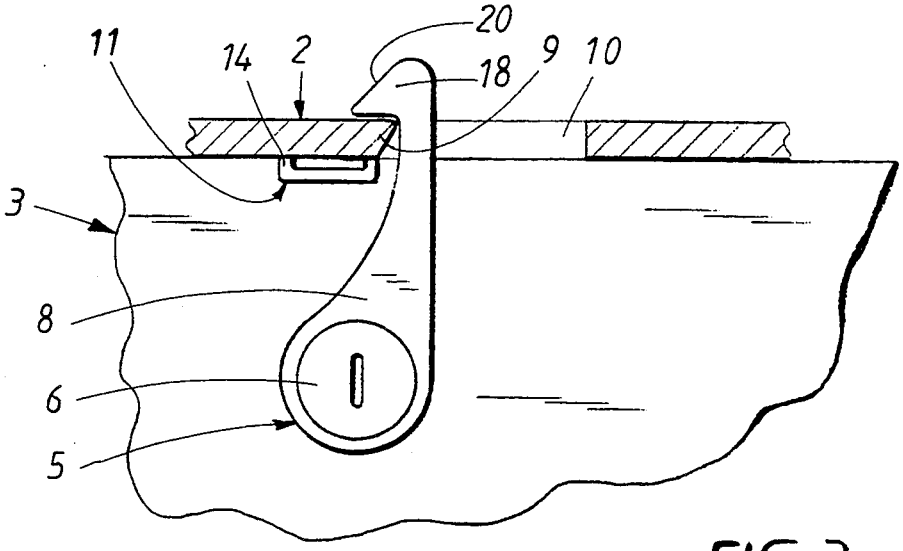
FIGS. 3, 4 and 5 show schematically the principle for the functioning of the container lock by way of views of the container lock in different positions.
Figure 4:
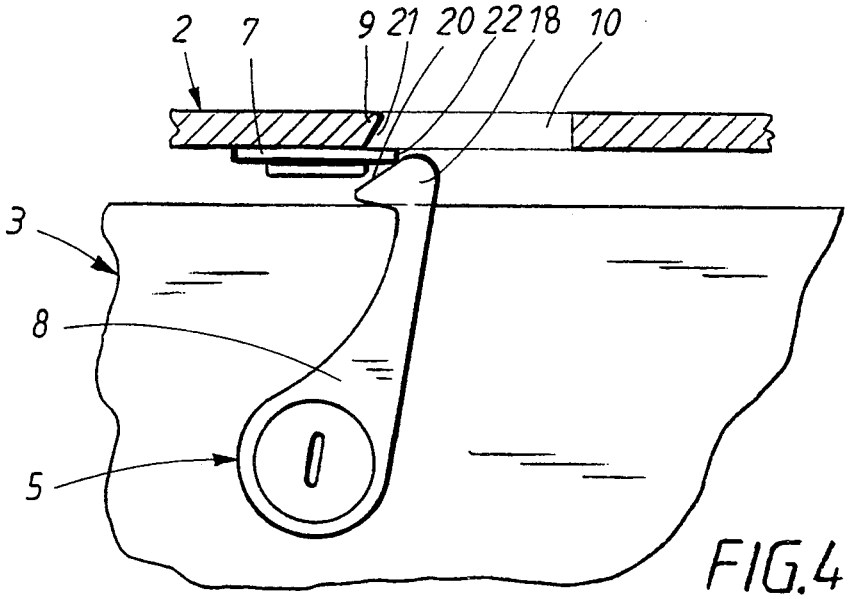
Figure 5:
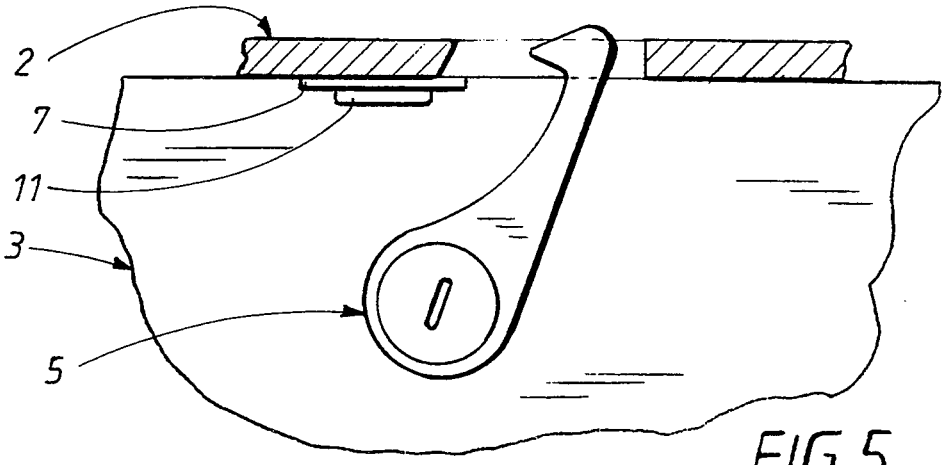

With reference to FIGS. 3, 4 and 5, the operation of the arrangement according to the invention will now be described. FIG. 3 shows the lock 5 in the lock position, whereby its lock catch 8 engages around the lock edge 9 with its blocking hook 18, said lock edge preferably being chamfered on its side which faces the locking hook 18. In turn the locking hook is foreseen with a slanted guiding edge 20 which allows the locking hook 18, in a conventional manner, to be guided around the lock edge 9 upon closing the cover 3. The lock 5 is of the type where the lock catch 8 is spring biased by a spring mechanism (not shown) so that the lock catch 8 tries to assume the lock position shown in FIG. 3. A torque in the anti-clockwise direction towards an end position is applied thus to the lock by means of the spring mechanism, which is adapted so that the guide edge 20 will abut against the chamfer 21 in the lock edge during the locking procedure.

When the user does not wish to make use of the lock 5, the key 7 is placed in the key holder 11 whereby the following occurs, see FIG. 4. The key holder 11 is so placed, such that the edge 22 of the key, which projects past the lock edge 9 forms an abutment edge for the guide edge 20 of the lock catch, whereby the lock catch is caused to be guided in an anti-clockwise direction past a limit position, i.e. an angular position in the turning movement of the lock catch, in which the spring mechanism's torque proceeds to turn the lock catch 8 in the opposite direction, i.e. clockwise towards an end position shown in FIG. 5. In the cover's closed position the cover is thus retained by the snap lock, whilst the lock 5 remains in the free position, meaning that the lock hook 18 will not grip around either the lock edge or the key, without the cover being able to be opened easily by hand by being swung outwardly, whereby the blocking hook 18 is guided through the opening 10 without hindrance.

With the above described arrangement the key can thus be stored in the container in a secure manner, without risk that the key may be unintentionally locked in. When it is wished to use the lock 5 again, the key is withdrawn from the key holder 11, placed in its slot in the lock cylinder 6, whereby the lock catch 8 is rotated anti-clockwise by hand and it passes the critical position in which the spring mechanism goes back again to ensure that the lock hook is guided in behind the lock edge 9. Locking can thereby occur by means of the key whereafter the key can be removed from the lock and be taken away.

The invention is not limited to the embodiments which are shown in the drawings and described above, but can be varied within the scope of the following claims. For example, the lock 5 can be of a different type, for example with a lock catch which is movable forwards and backwards linearly, which can be guided behind a lock edge by spring action when the key is so positioned that the lock catch is prevented from being displaced behind the lock edge. Additionally the snap lock can be replaced by another lock, for example friction locking where the friction, in the joint locations for example, is so high that the cover is maintained in the closed position.

What is claimed is:

1. A lockable container having an interior and an exterior, said container comprising a base part;

a cover pivotally attached to the base part for displacement between a closed position in which the cover and the base delimit a substantially enclosed space and an open position;

a lock mounted on said container, said lock presenting a lock catch operable from the exterior of the container by a key, which catch is displaceable between a locking position in which said catch engages a receiving portion and a free position;

wherein on the interior of the container, the container presents a holder for said key when said lock is not being activated, said holder being located with respect to the receiving portion such that the lock catch, through mechanical contact with the key, is prevented from engaging the receiving portion when the cover is in said closed position.

2. The container as claimed in claim 1, wherein the lock is located on the cover and said receiving portion is located on the base part, said receiving portion being in the form of an opening having an opening edge portion behind which the lock catch is arranged to engage in said locking position.

3. The container as claimed in claim 2, wherein the holder is located below said opening so that a portion of said key is placed in front of said opening edge portion to thereby displace said lock catch away from said opening edge portion during displacement of said cover from said open position to said closed position.

4. The container as claimed in claim 3, wherein said holder is a closed holder loop comprising an upper edge part and inwardly facing surfaces, said upper edge part and inwardly facing surfaces supporting said key in a substantially vertical position.

5. The container as claimed in claim 3, wherein the lock presents a spring mechanism which, in a first angular range of the lock catch's displacement, is arranged to maintain a torque which strives to move the lock catch into the locking position, and in a second angular interval is arranged to maintain a torque which strives to move the lock catch in the opposite direction, whereby the lock catch, for the purposes of locking, is maintained within the first angular interval.

6. The container as claimed in claim 5, wherein the holder is so located that with the key therein, the key brings the lock catch into the second angular interval during closing of the cover.

* * * * *